US011944214B2

(12) United States Patent
Appleby

(10) Patent No.: US 11,944,214 B2
(45) Date of Patent: Apr. 2, 2024

(54) MODEL DISPLAY STAND FOR SIMULATING THE ACTION OF BURNING RUBBER OR BLOWING SMOKE

(71) Applicant: Lee Allen Appleby, Johnson Creek, WI (US)

(72) Inventor: Lee Allen Appleby, Johnson Creek, WI (US)

( * ) Notice: Subject to any disclaimer, the term of this patent is extended or adjusted under 35 U.S.C. 154(b) by 0 days.

(21) Appl. No.: 18/302,660

(22) Filed: Apr. 18, 2023

(65) Prior Publication Data

US 2023/0329456 A1 Oct. 19, 2023

Related U.S. Application Data

(60) Provisional application No. 63/332,315, filed on Apr. 19, 2022.

(51) Int. Cl.

| | |
|---|---|
| ***A47F 5/12*** | (2006.01) |
| ***A47F 5/16*** | (2006.01) |
| ***A47F 7/00*** | (2006.01) |
| ***A63H 33/42*** | (2006.01) |

(52) U.S. Cl.

CPC ..... *A47F 5/12* (2013.01); *A63H 33/42* (2013.01); *A47F 2005/165* (2013.01); *A47F 2007/0092* (2013.01)

(58) Field of Classification Search

CPC ..... A47F 5/12; A47F 2007/0092; A47F 2005/165; A47F 5/16; A63H 17/44; A63H 33/42; A63H 33/16

USPC ..... 211/13.1, 73, 43; 446/487, 488, 25; 206/495, 45.24; 248/454, 455; D6/674, D6/674.1

See application file for complete search history.

(56) References Cited

U.S. PATENT DOCUMENTS

D58,296 S * 7/1921 Wurth ..... D6/674
D169,832 S * 6/1953 Waldrop ..... D6/674.1

(Continued)

OTHER PUBLICATIONS

3ders, retrieved from the internet, retrieved on Jan. 18, 2018; <URL: http://www.3ders.org/articles/20141205-cults-top-20-3d-printable-toy-models-for-christmas.html#:~: text=Cults%27%20Top%2018%203D%20printable%20toy%20models%20for,8.%20Fire%20Husky%20by%20HelloBard%20. . . %20More%20items>.

(Continued)

*Primary Examiner* — Jennifer E. Novosad

(57) ABSTRACT

A model display stand is an apparatus that is used to display model cars in a position simulating the act of burning rubber. The apparatus includes a base panel, a propping tab, a first smoke-cloud-shaped wall, a second smoke-cloud-shaped wall, a first smoke-trail-shaped protrusion, and a second smoke-trail-shaped protrusion. The base panel serves to support portions of a model car when the model car is mounted onto the apparatus. The propping tab serves to elevate portions of the model car to display the model car in a wheelie position. The first smoke-cloud-shaped wall and the second cloud-shaped wall surround the base panel and the model car mounted onto the base panel. Along with the first smoke-trail-shaped protrusion and the second smoke-trail-shaped protrusion, the first smoke-cloud-shaped wall and the second smoke-cloud-shaped wall also serve to simulate the act of burning rubber by the model car.

18 Claims, 7 Drawing Sheets

(56) References Cited

U.S. PATENT DOCUMENTS 3,509,662 A * 5/1970 Lunzer ..... A63H 18/023 446/444
3,621,602 A * 11/1971 Barcus et al. ..... A63H 18/028 104/54
4,416,493 A * 11/1983 Sumner ..... A63H 3/52 D6/567
4,519,789 A * 5/1985 Halford ..... A63H 18/028 446/431
4,979,926 A * 12/1990 Bisceglia ..... A63H 33/30 446/4
5,038,685 A * 8/1991 Yoneda ..... A63H 18/028 104/54
D328,987 S * 9/1992 Jurgens ..... D6/674.1
D328,994 S * 9/1992 Jurgens ..... D6/563
5,232,105 A * 8/1993 Gregg ..... A47F 5/025 211/113
5,560,500 A * 10/1996 Wilcox ..... A47F 7/00 211/13.1
5,676,586 A * 10/1997 James ..... A63H 18/02 463/58
D395,562 S * 6/1998 Goodman ..... D6/672
D408,653 S * 4/1999 Dotson ..... D6/674
5,941,176 A * 8/1999 Schultz ..... A47F 5/16 312/223.5
D420,535 S * 2/2000 Klock ..... D6/675.4
6,059,122 A * 5/2000 Cartmell ..... A47F 5/0892 211/85.3
6,315,258 B1 * 11/2001 Myler ..... A47F 5/083 211/95
6,467,632 B1 * 10/2002 Guillot ..... A47F 11/10 211/13.1
6,499,589 B1 12/2002 Ngan
6,761,609 B1 * 7/2004 Andersen ..... A63H 33/42 446/124
D534,011 S 12/2006 Stevens
7,223,152 B2 * 5/2007 Anderson ..... A63H 33/16 446/176
D569,128 S 5/2008 Stearns et al.
7,517,272 B2 * 4/2009 Bedford ..... A63H 21/04 446/444
7,686,272 B2 * 3/2010 King ..... A47G 1/12 248/458
7,690,964 B2 * 4/2010 Nuttall ..... A63H 18/028 446/168
7,897,262 B1 * 3/2011 Chambers ..... E04F 19/02 428/542.2
8,245,856 B1 * 8/2012 Pappin ..... A63H 17/00 211/13.1
D672,166 S 12/2012 Newman
9,609,962 B2 * 4/2017 Bruns ..... A47F 7/0042
10,912,399 B2 * 2/2021 Cianchino ..... A47F 3/004
2005/0218098 A1 * 10/2005 Angen ..... A47B 96/061 211/187
2007/0187567 A1 * 8/2007 Ruane ..... A47F 7/00 248/560
2008/0051001 A1 * 2/2008 Nuttall ..... A63H 18/023 446/444
2013/0240704 A1 * 9/2013 Andrews ..... F16M 13/00 248/454
2013/0270413 A1 * 10/2013 Wilber ..... F16M 11/00 248/558
2017/0245662 A1 * 8/2017 Schlegel ..... A47F 5/16

OTHER PUBLICATIONS

Cloud stand, retrieved from the internet, retrieved on Apr. 18, 2023; <URL:https://qualydesign.com/international/shop/everyday-essentials/cloud-stand/>.

* cited by examiner

MODEL DISPLAY STAND FOR SIMULATING THE ACTION OF BURNING RUBBER OR BLOWING SMOKE

The current application claims a priority to the U.S. provisional patent application Ser. No. 63/332,315 filed on Apr. 19, 2022.

FIELD OF THE INVENTION

The present invention relates generally to display stands and model cars. More specifically, the present invention is a universal display stand for model cars that simulates the action of burning rubber or blowing smoke.

BACKGROUND OF THE INVENTION

Nowadays, building model kits is one of the most popular hobbies. These model kits include miniature representations of various objects including cars, trains, airplanes, etc. Once the model has been constructed, it is usual for the model to be displayed for public viewing. Various devices and tools are available for the public display of miniature models. For example, display cases are available that store several models in such a way that each model can be viewed while the models are safely stored. In addition, various devices are available that enable the mounting of the models in such a way that a real-life action is simulated. For example, tilting car stands are available that position the model car in a position resembling the turning of racing cars in a speedway. However, most of these stands are specifically designed for certain models which limit the use of the stand with a wide range of model cars. Therefore, there is a need for a model car stand that can support a wide range of car models and that simulates real-life actions with the model car.

The objective of the present invention is to provide a model display stand designed to support a wide range of model cars. Another objective of the present invention is to provide a model display stand that is designed to position the model car in an action-like configuration. The present invention is preferably designed to retain the model car in such a way that the model car appears to be burning rubber or blowing smoke. Another objective of the present invention is to provide a model display stand that can support the model car in various orientations. The present invention can retain the model car in a skidding position or in a wheelie position. Additional features and benefits of the present invention are further discussed in the sections below.

SUMMARY OF THE INVENTION

The present invention is a model display stand for model cars. The present invention is preferably designed in the shape of smoke to display a model car such as a 1:64 toy car in the wheelie position, skidding position, or any other position in between. The present invention is designed to ornamentally simulate the action of burning rubber where an accelerating car is generating smoke resulting from the friction of the car wheels against the road. The present invention can cover all model car scales including, but not limited to, 1:1, 1:18, 1:24, 1/32, 1:43, 1:64, and 1:87 scales.

The present invention is preferably designed with a flat surface area where the model car's rear wheels can be positioned depending on the user's preference. Further, the present invention includes smoke-puff-shaped hooks that retain the bumper or trunk of the model car in the wheelie position. Further, there are smoke-puff-shaped walls on each side of the flat display area as well as puffs of smoke behind the flat display area. In addition, the present invention includes a utilitarian hinged flap located on the front of the display area. The hinged flap is used to display the model car in the wheelie position when flipped up or to display the model car flat on the display surface area when folded down. Furthermore, the underside of the present invention can be marked with a serial number per part and logo. The present invention can be manufactured using injection molding methods and be one piece.

DETAIL DESCRIPTIONS OF THE INVENTION

Figure 1:
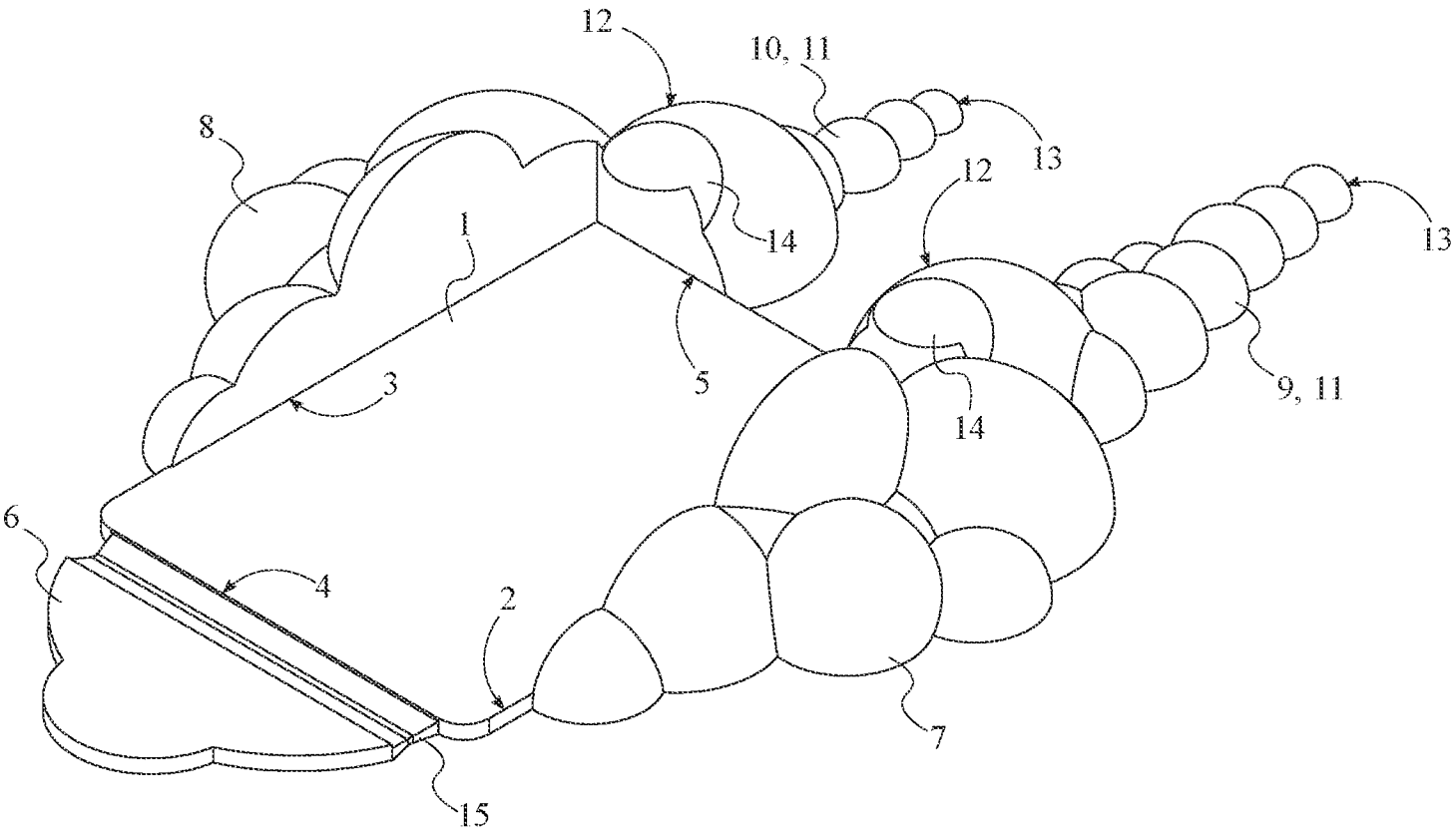
FIG. 1 is a top front perspective view of the present invention.
Figure 2:
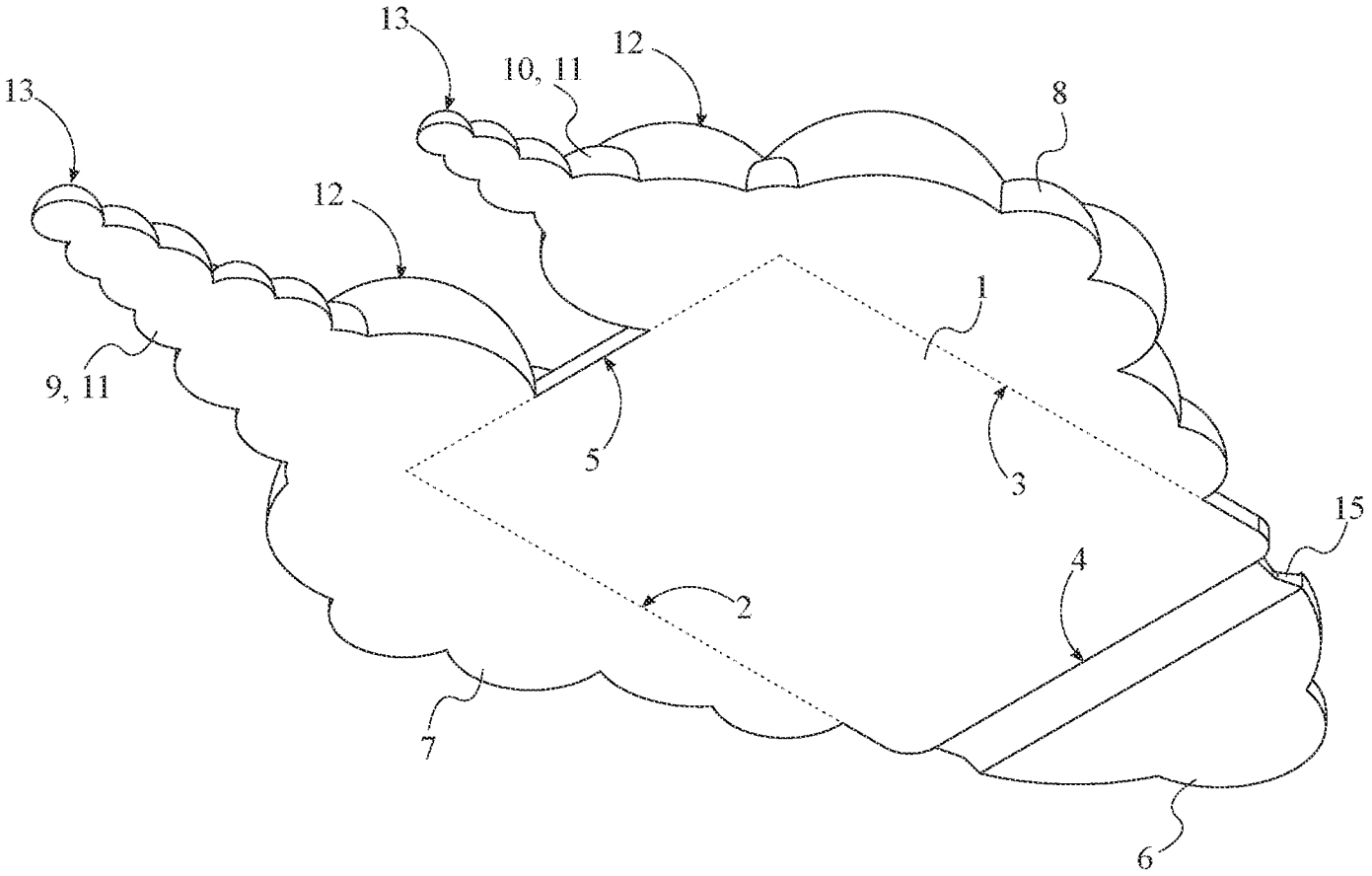
FIG. 2 is a bottom rear perspective view of the present invention.
Figure 3:
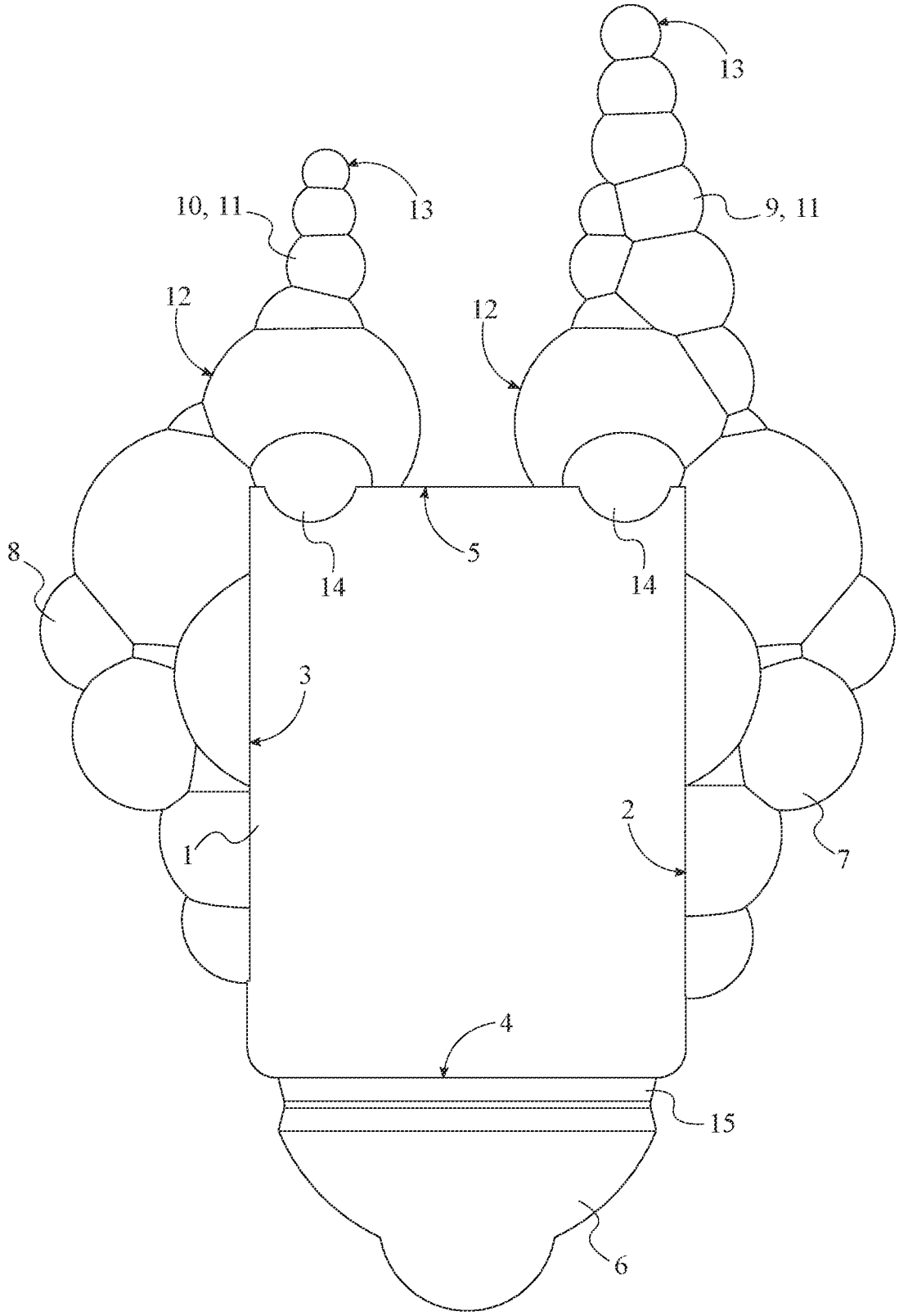
FIG. 3 is a top view of the present invention.

All illustrations of the drawings are for the purpose of describing selected versions of the present invention and are not intended to limit the scope of the present invention.

The present invention is a model display stand that is used to display model cars in a position simulating the act of burning rubber. As can be seen in FIGS. 1 through 7, the present invention preferably comprises a base panel 1, a propping tab 6, a first smoke-cloud-shaped wall 7, a second smoke-cloud-shaped wall 8, a first smoke-trail-shaped protrusion 9, and a second smoke-trail-shaped protrusion 10. The base panel 1 serves to support portions of the model car when the model car is mounted onto the present invention. The propping tab 6 serves to elevate portions of the model car to display the model car in a wheelie position. The first smoke-cloud-shaped wall 7 and the second smoke-cloud-shaped wall 8 surround the base panel 1 and the model car mounted onto the base panel 1. Along with the first smoke-trail-shaped protrusion 9 and the second smoke-trail-shaped protrusion 10, the first smoke-cloud-shaped wall 7 and the second smoke-cloud-shaped wall 8 also serve to simulate the act of burning rubber by the model car.

The general configuration of the aforementioned components enables the user to display a model car in such a way that the model car looks like is burning rubber. As can be seen in FIGS. 1 through 7, to support most model cars, the base panel 1 is preferably designed as a flat rectangular structure large enough to accommodate most model car scales. To do so, the base panel 1 comprises a first lateral edge 2, a second lateral edge 3, a leading edge 4, and a trailing edge 5. The first lateral edge 2, the second lateral edge 3, the leading edge 4, and the trailing edge 5 correspond to the lateral edges of the base panel 1. To form the rectangular shape of the base panel 1, the first lateral edge 2 is positioned opposite the second lateral edge 3 across the base panel 1. Further, the leading edge 4 and the trailing edge 5 are positioned in between the first lateral edge 2 and the second lateral edge 3 to form a closed rectangular structure. In addition, the leading edge 4 is positioned opposite the trailing edge 5 across the base panel 1 to finalize the rectangular shape of the base panel 1. Further, the propping tab 6 is hingedly connected to the leading edge 4 so that the propping tab 6 can be folded upwards to raise portions of the model car. This way, the user can prop up the model car using the propping tab 6 to position the model car in the wheelie position or any other desired position. Alternatively, the user can unfold the propping tab 6 to position the model car flat on the base panel 1 and on the supporting surface.

As can be seen in FIGS. 1 through 7, the base panel 1 is preferably surrounded by the first smoke-cloud-shaped wall 7 and the second smoke-cloud-shaped wall 8 so that the rear of the model car is surrounded by the smoke-cloud-shaped walls. To do so, the first smoke-cloud-shaped wall 7 is laterally connected along the first lateral edge 2 to secure the first smoke-cloud-shaped wall 7 to the base panel 1. Similarly, the second smoke-cloud-shaped wall 8 is laterally connected along the second lateral edge 3 to secure the second smoke-cloud-shaped wall 8 to the base panel 1. This way, when the rear of the model car is mounted onto the base panel 1, the model car's rear wheels are hidden by the smoke-cloud-shaped walls to simulate the burning rubber action of the model car's rear wheels. Furthermore, the first smoke-trail-shaped protrusion 9 is connected onto the trailing edge 5, adjacent to the first smoke-cloud-shaped wall 7, to secure the first smoke-trail-shaped protrusion 9 to the base panel 1. Similarly, the second smoke-trail-shaped protrusion 10 is connected onto the trailing edge 5, adjacent to the second smoke-cloud-shaped wall 8, to secure the second smoke-trail-shaped protrusion 10 to the base panel 1. Thus, the model car's rear wheels are surrounded by the smoke-cloud-shaped walls and the smoke-trail-shaped protrusions to create the illusion of smoke generated by the burning rubber of the model car's rear wheels.

As can be seen in FIGS. 1 through 7, to maximize the effect of burning rubber, the first smoke-trail-shaped protrusion 9 and the second smoke-trail-shaped protrusion 10 are designed to simulate the speeding of the model car mounted onto the base panel 1 or to simulate the smoke generated being blown away from the model car. To do so, the first smoke-trail-shaped protrusion 9 and the second smoke-trail-shaped protrusion 10 may each comprise an elongated protrusion body 11, a wider protrusion end 12, and a narrower protrusion end 13. The elongated protrusion body 11 is preferably shaped to simulate a dissipating smoke trail. The wider protrusion end 12 is designed to simulate a large amount of smoke generated by the model car's rear wheels, while the narrower protrusion end 13 is designed to simulate a small amount of smoke as the smoke dissipates away from the model car. Accordingly, the wider protrusion end 12 and the narrower protrusion end 13 are positioned opposite to each other along the elongated protrusion body 11 due to the elongated design of the elongated protrusion body 11. Further, the wider protrusion end 12 is connected adjacent to the trailing edge 5 so that the wider protrusion end 12 is positioned adjacent to the model car's rear. On the other hand, the narrower protrusion end 13 is positioned offset from the trailing edge 5. In other embodiments, the first smoke-trail-shaped protrusion 9 and the second smoke-trail-shaped protrusion 10 can be designed to simulate a different driving effect for the model car mounted onto the base panel 1.

Figure 6:
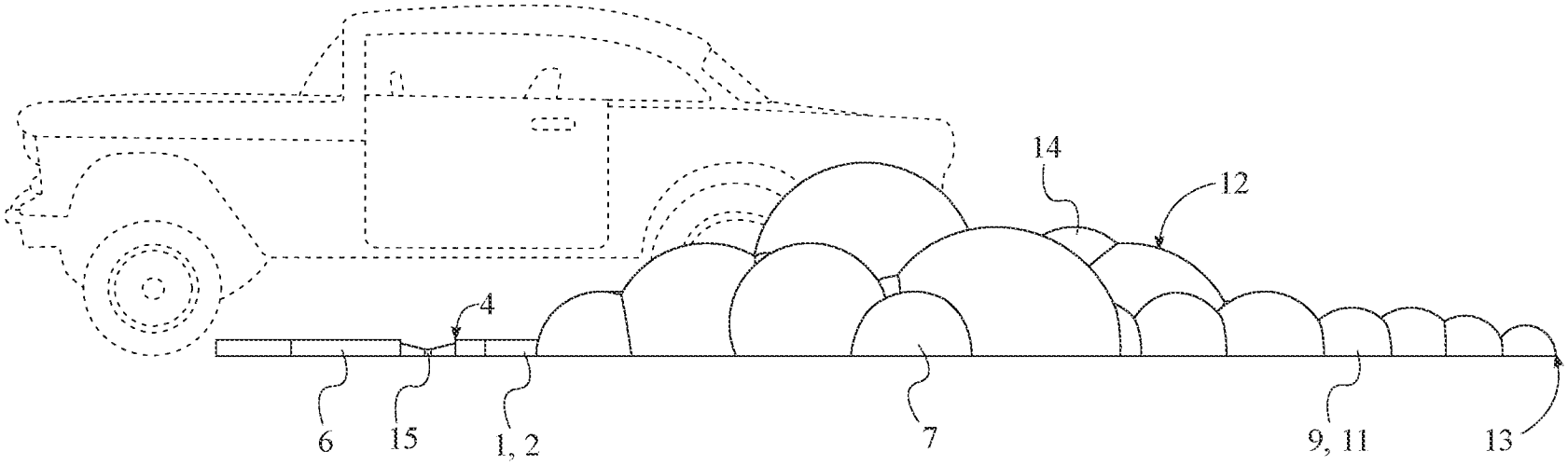
FIG. 6 is a side view of the present invention, wherein a model car mounted onto the present invention is shown in a resting configuration.
Figure 7:
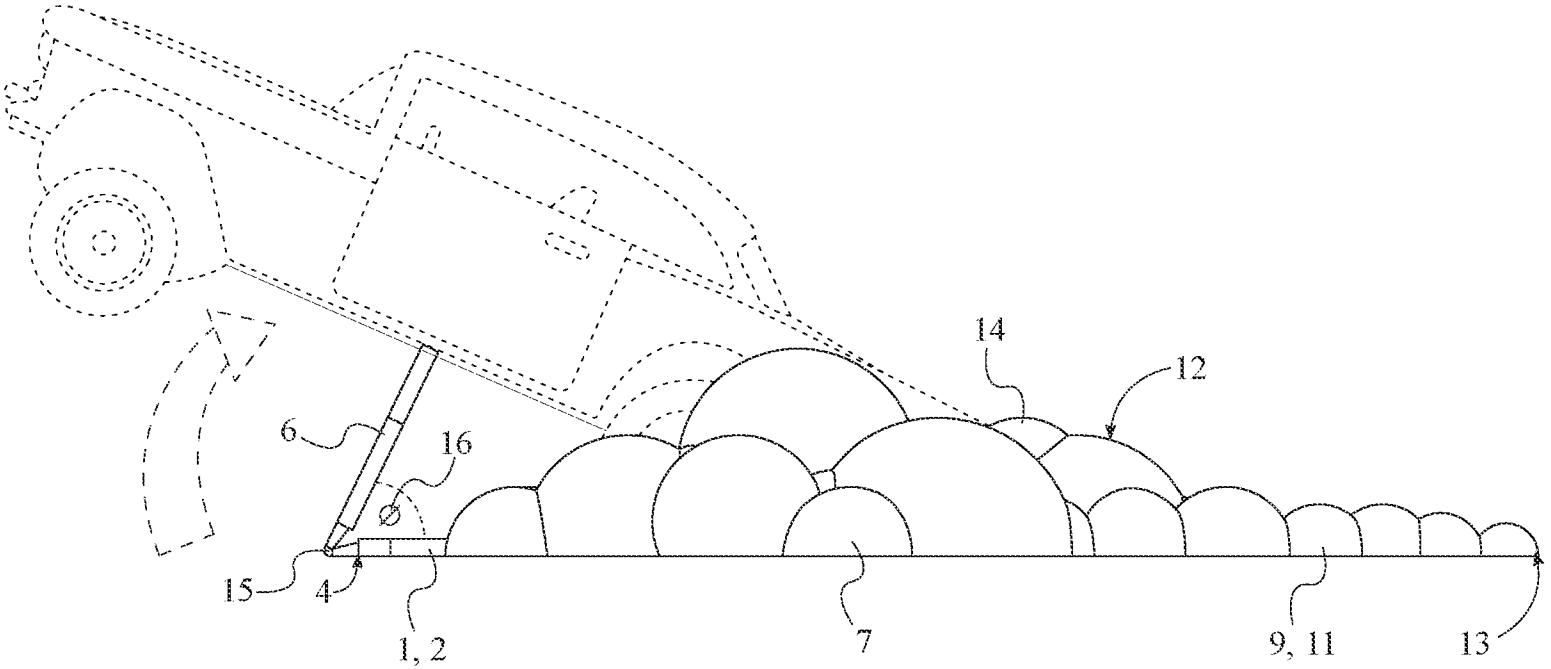
FIG. 7 is a side view of the present invention, wherein the model car mounted onto the present invention is shown in a propping configuration.

As previously discussed, the present invention allows the user to position the model car mounted onto the base panel 1 in different positions. As can be seen in FIG. 6, in a resting configuration, the propping tab 6 is positioned parallel to the base panel 1 so that the model car rests flat on the base panel 1 and the surface on which the present invention is placed on. Alternatively, as can be seen in FIG. 7, in a wheelie configuration, the propping tab 6 is oriented at a propping angle 16 with the base panel 1 to position the model car in a wheelie position. In the wheelie configuration, the user preferably positions the model car's rear on the base panel 1. The propping tab 6 engages with the model car's bottom to lift the model car's front. Further, the propping angle 16 can be 45 degrees to balance the model car on the propping tab 6. In other embodiments, the user can position the model car on the present invention in different configurations by changing the propping angle 16 of the propping tab 6.

In some embodiments, the present invention may further comprise a tab connector 15 that facilitates the folding of the propping tab 6. As can be seen in FIGS. 1 through 7, the tab connector 15 can be a piece of thin material that connects the propping tab 6 to the base panel 1 to provide an area that can be easily folded without damaging the base panel 1 or the propping tab 6. To do so, the propping tab 6 is hingedly connected to the leading edge 4 by the tab connector 15. This way, the user can freely fold the propping tab 6 at the desired propping angle 16 without risk of separating the propping tab 6 from the base panel 1. Further, the propping tab 6 and the tab connector 15 are centrally positioned along the leading edge 4 to support the weight of the model car evenly.

Figure 4:
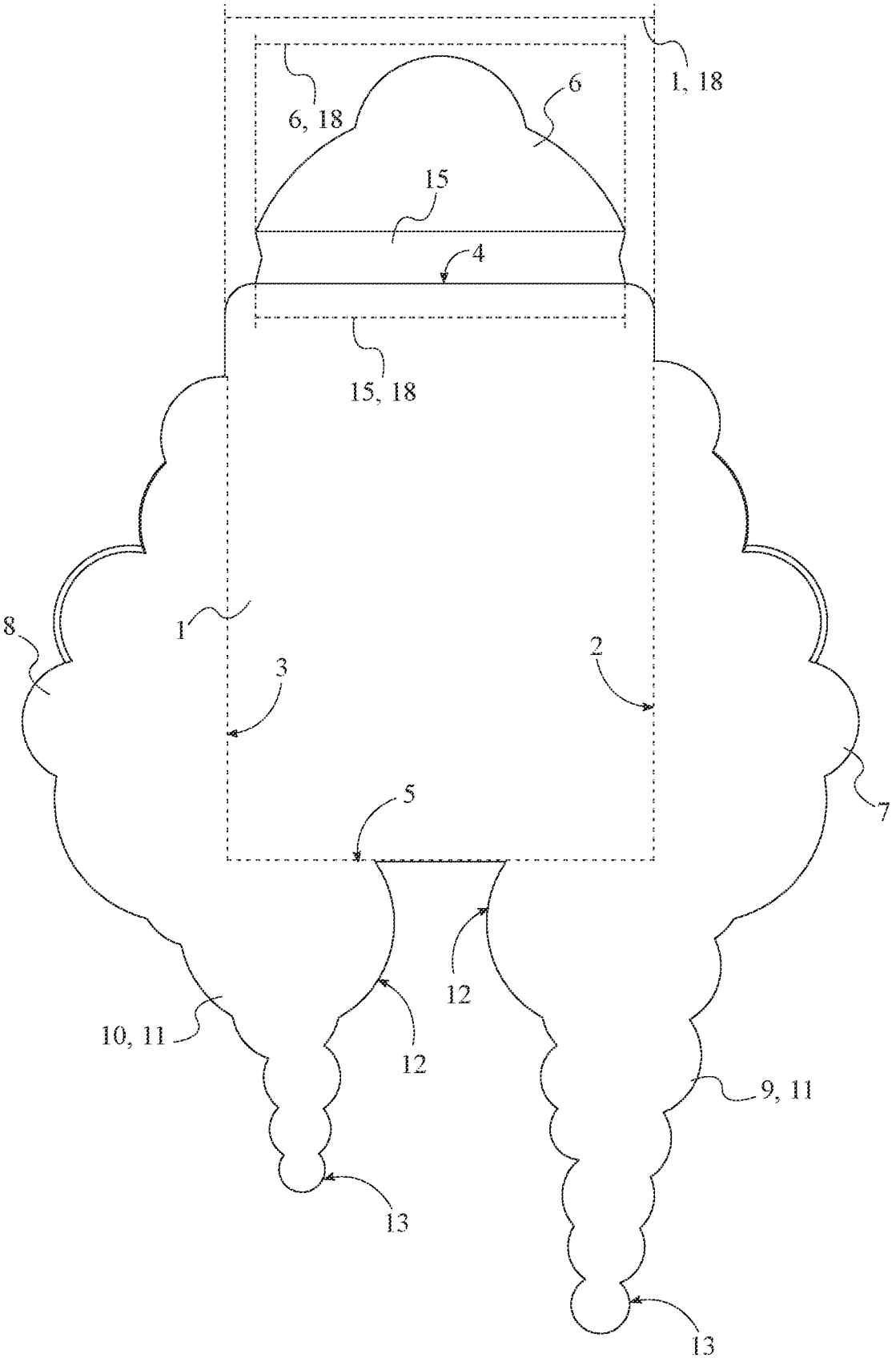
FIG. 4 is a bottom view of the present invention.
Figure 5:
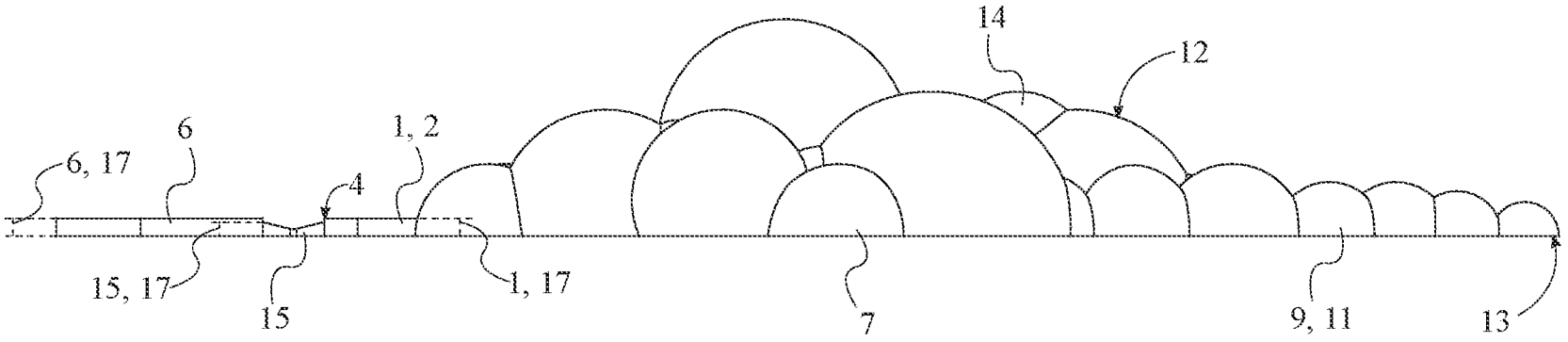
FIG. 5 is a side view of the present invention.

In the preferred embodiment, as can be seen in FIG. 5, a thickness 17 of the propping tab 6 can be greater than a thickness 17 of the tab connector 15 so that the tab connector 15 can be easier to bend. In addition, a thickness 17 of the base panel 1 can be greater than the thickness 17 of the tab connector 15. The thickness 17 of the propping tab 6 and the thickness 17 of the base panel 1 can also be equal. Further, as can be seen in FIG. 4, a width 18 of the propping tab 6 is less than a width 18 of the base panel 1 so that the propping tab 6 can be hidden under the model car when the model car is positioned on the base panel 1. Similarly, a width 18 of tab connector 15 is less than the width 18 of the base panel 1 so that the tab connector 15 can be hidden under the model car when the model car is positioned on the base panel 1.

In some embodiments, the present invention can provide means to retain the model car in the wheelie position so that the weight of the model car does not cause the model car to move accidentally from the wheelie position. As can be seen in FIGS. 1 through 7, the first smoke-trail-shaped protrusion 9 and the second smoke-trail-shaped protrusion 10 may each further comprise a model-restraining feature 14. The model-restraining feature 14 is designed to engage with a portion of the model car, such as the model car's rear bumper or the trunk, to maintain the model car's rear positioned against the base panel 1. Accordingly, the model-restraining feature 14 is positioned offset from the trailing edge 5 so that the model-restraining feature 14 can accommodate different model scales. The model-restraining feature 14 is also integrated into the wider protrusion end 12 so that the model-restraining feature 14 is seamlessly integrated with the rest of the design of the present invention. In some embodiments, the model-restraining feature 14 can be a hook designed to engage with the model car's rear. In other embodiments, the present invention can include different means to retain the model car's rear while the model car is in the wheelie position.

Although the invention has been explained in relation to its preferred embodiment, it is to be understood that many other possible modifications and variations can be made without departing from the spirit and scope of the invention.

What is claimed is:

1. A model display stand for simulating the action of burning rubber or blowing smoke comprising:
a base panel;
a propping tab;
a first smoke-cloud-shaped wall;
a second smoke-cloud-shaped wall;
a first smoke-trail-shaped protrusion;
a second smoke-trail-shaped protrusion;
the base panel comprising a first lateral edge, a second lateral edge, a leading edge, and a trailing edge;
the first lateral edge being positioned opposite the second lateral edge across the base panel;
the leading edge and the trailing edge being positioned in between the first lateral edge and the second lateral edge;
the leading edge being positioned opposite the trailing edge across the base panel;
the propping tab being hingedly connected to the leading edge;
the first smoke-cloud-shaped wall being laterally connected along the first lateral edge;
the second smoke-cloud-shaped wall being laterally connected along the second lateral edge;
the first smoke-trail-shaped protrusion being connected onto the trailing edge, adjacent to the first smoke-cloud-shaped protrusion; and
the second smoke-trail-shaped protrusion being connected onto the trailing edge, adjacent to the second smoke-cloud-shaped protrusion.

2. The model display stand for simulating the action of burning rubber or blowing smoke as claimed in claim 1 comprising:
the first smoke-trail-shaped protrusion and the second smoke-trail-shaped protrusion each comprising an elongated protrusion body, a wider protrusion end, and a narrower end;
the wider protrusion end and the narrower protrusion end being positioned opposite to each other along the elongated protrusion body;
the wider protrusion end being connected adjacent to the trailing edge; and
the narrower protrusion end being positioned offset from the trailing edge.

3. The model display stand for simulating the action of burning rubber or blowing smoke as claimed in claim 1 comprising:
wherein the propping tab and the base panel are arranged into a resting configuration; and
the propping tab being positioned parallel to the base panel.

4. The model display stand for simulating the action of burning rubber or blowing smoke as claimed in claim 1 comprising:
wherein the propping tab and the base panel are arranged into a wheelie configuration; and
the propping tab being oriented at a propping angle with the base panel.

5. The model display stand for simulating the action of burning rubber or blowing smoke as claimed in claim 4, wherein the propping angle is 45 degrees.

6. The model display stand for simulating the action of burning rubber or blowing smoke as claimed in claim 1 comprising:
a tab connector; and
the propping tab being hingedly connected to the leading edge by the tab connector.

7. The model display stand for simulating the action of burning rubber or blowing smoke as claimed in claim 6 comprising:
the propping tab and the tab connector being centrally positioned along the leading edge.

8. The model display stand for simulating the action of burning rubber or blowing smoke as claimed in claim 6, wherein a thickness of the propping tab is greater than a thickness of the tab connector, and wherein a thickness of the base panel is greater than the thickness of the tab connector.

9. The model display stand for simulating the action of burning rubber or blowing smoke as claimed in claim 6, wherein a width of the propping tab is less than a width of the base panel, and wherein a width of tab connector is less than the width of the base panel.

10. The model display stand for simulating the action of burning rubber or blowing smoke as claimed in claim 1 comprising:
the first smoke-trail-shaped protrusion and the second smoke-trail-shaped protrusion each comprising an elongated protrusion body, a wider protrusion end, and a narrower end, and a model-restraining feature;
the wider protrusion end and the narrower protrusion end being positioned opposite to each other along the elongated protrusion body;
the model-restraining feature being positioned offset from the trailing edge; and
the model-restraining feature being integrated into the wider protrusion end.

11. A model display stand for simulating the action of burning rubber or blowing smoke comprising:
a base panel;
a propping tab;
a first smoke-cloud-shaped wall;
a second smoke-cloud-shaped wall;
a first smoke-trail-shaped protrusion;
a second smoke-trail-shaped protrusion;
a tab connector;
the base panel comprising a first lateral edge, a second lateral edge, a leading edge, and a trailing edge;
the first lateral edge being positioned opposite the second lateral edge across the base panel;
the leading edge and the trailing edge being positioned in between the first lateral edge and the second lateral edge;
the leading edge being positioned opposite the trailing edge across the base panel;
the first smoke-cloud-shaped wall being laterally connected along the first lateral edge;
the second smoke-cloud-shaped wall being laterally connected along the second lateral edge;
the first smoke-trail-shaped protrusion being connected onto the trailing edge, adjacent to the first smoke-cloud-shaped protrusion;
the second smoke-trail-shaped protrusion being connected onto the trailing edge, adjacent to the second smoke-cloud-shaped protrusion;
the propping tab and the tab connector being centrally positioned along the leading edge; and
the propping tab being hingedly connected to the leading edge by the tab connector.

12. The model display stand for simulating the action of burning rubber or blowing smoke as claimed in claim 11 comprising:

the first smoke-trail-shaped protrusion and the second smoke-trail-shaped protrusion each comprising an elongated protrusion body, a wider protrusion end, and a narrower end;

the wider protrusion end and the narrower protrusion end being positioned opposite to each other along the elongated protrusion body;

the wider protrusion end being connected adjacent to the trailing edge; and the narrower protrusion end being positioned offset from the trailing edge.

13. The model display stand for simulating the action of burning rubber or blowing smoke as claimed in claim 11 comprising:

wherein the propping tab and the base panel are arranged into a resting configuration; and the propping tab being positioned parallel to the base panel.

14. The model display stand for simulating the action of burning rubber or blowing smoke as claimed in claim 11 comprising:

wherein the propping tab and the base panel are arranged into a wheelie configuration; and the propping tab being oriented at a propping angle with the base.

15. The model display stand for simulating the action of burning rubber or blowing smoke as claimed in claim 14, wherein the propping angle is 45 degrees.

16. The model display stand for simulating the action of burning rubber or blowing smoke as claimed in claim 11, wherein a thickness of the propping tab is greater than a thickness of the tab connector, and wherein a thickness of the base panel is greater than the thickness of the tab connector.

17. The model display stand for simulating the action of burning rubber or blowing smoke as claimed in claim 11, wherein a width of the propping tab is less than a width of the base panel, and wherein a width of tab connector is less than the width of the base panel.

18. The model display stand for simulating the action of burning rubber or blowing smoke as claimed in claim 11 comprising:

the first smoke-trail-shaped protrusion and the second smoke-trail-shaped protrusion each comprising an elongated protrusion body, a wider protrusion end, and a narrower end, and a model-restraining feature;

the wider protrusion end and the narrower protrusion end being positioned opposite to each other along the elongated protrusion body;

the model-restraining feature being positioned offset from the trailing edge; and the model-restraining feature being integrated into the wider protrusion end.

* * * * *